US005688010A

United States Patent [19]

Moyer

[11] Patent Number: 5,688,010

[45] Date of Patent: Nov. 18, 1997

[54] COIL EDGE PROTECTION FROM LIFTING DEVICE

[75] Inventor: William K. Moyer, Zanesville, Ohio

[73] Assignee: Armco Inc., Middletown, Ohio

[21] Appl. No.: 661,282

[22] Filed: Jun. 10, 1996

[51] Int. Cl.[6] ..... B66C 1/22

[52] U.S. Cl. ..... 294/67.2

[58] Field of Search ..... 294/1.1, 67.1–67.22, 294/67.3, 67.33, 82.1, 86.4, 99.1, 103.2, 106, 902; 414/619, 684, 729, 910, 911

[56] References Cited

U.S. PATENT DOCUMENTS

| | | | |
|---|---|---|---|
| 1,591,248 | 7/1926 | Tracy | 294/67.2 X |
| 3,275,367 | 9/1966 | Bopp | 294/67.21 |
| 3,291,519 | 12/1966 | Burke | 294/67.2 |
| 4,641,876 | 2/1987 | Kiser et al. | 294/86.4 |
| 4,709,953 | 12/1987 | Sirota | 294/103.2 X |
| 4,717,188 | 1/1988 | Johnston | 294/67.2 |
| 4,784,419 | 11/1988 | Jensen et al. | 294/67.2 |
| 4,919,465 | 4/1990 | Gembarosky et al. | 294/67.2 |

*Primary Examiner*—Johnny D. Cherry
*Attorney, Agent, or Firm*—R. J. Bunyard; L. A. Fillnow

[57] ABSTRACT

A coil lifter (26) adapted for being suspended from an overhead crane for lifting a coil (10) of strip material having a central opening (14). The lifter includes a vertical lifting arm (28), an upper portion (34), a lower portion (36), a lifting surface (42) on the lower arm portion for being inserted into and contacting a curvature (44) of the central opening of the coil. The lifting arm includes a facing surface (30) adjacent to a coil edge (16, 18), side surfaces (32, 33) and a pair of spaced apart rollers (46, 48) made from an elastic laminated material (72) for preventing damage to the edge of the coil. The rollers are rotatably supported by the lifting arm so that an annular outer surface (50) of each roller extends to a position between the coil edge and the facing surface.

14 Claims, 5 Drawing Sheets

COIL EDGE PROTECTION FROM LIFTING DEVICE

BACKGROUND OF THE INVENTION

The invention relates to a lifting device used for transporting a coil of strip material such as steel, aluminum, copper, paper or the like. More particularly, this invention relates to a coil lifter which protects an edge of the coil by providing cushioning means on a lifter arm to prevent the lifter arm from damaging the coil edge when picking up and transporting the coil.

During the processing of a coil of strip material, the coil normally is positioned, while at rest, with a central opening or core of the coil extending horizontally. The coil lifter used for transporting a coil may employ a single or a pair of lifter arms. The lower end of the lifter arm includes a lifting surface for insertion into the central opening on one or both ends of the coil. Regardless of whether the lifter has one or a pair of lifter arms, the inside or front surface of the lifter arm frequently will be impacted into the end or edge of the coil when the lifting surface of the lifter arm is inserted into the central opening of the coil. Since the edges of a metal strip in a coil between cold rolling and annealing normally are soft and do not possess great rigidity, severe damage can occur to the strip making it unusable. The strip edges can be wrinkled or bent by the impact of the lifting arm into the edge of the coil and/or by the abrasive movement of the lifting arm along the coil edge as the lifter arm is raised. The prior art has attempted to minimize edge damage to a coil by modifying the lifting arm of a coil lifter to include cushioning material.

In the case of when a single lifter arm is used, an overhead crane is used to lower the coil lifter to a position wherein the lifting arm is ready for entry opposite the central opening on either side of the coil. The lifting surface of the lifter arm then is inserted into the central opening. The coil is lifted by the crane as the lifting surface of the lifting arm contacts the upper curvature of the central opening. For example, U.S. Pat. No. 4,784,419; incorporated herein by reference, relates to a "C" hook type coil lifting device. The coil lifter includes one vertical lifting arm having an upper horizontal leg and a lower horizontal leg. The coil is lifted by inserting the lower leg into the central opening of the coil. The forward and rear surfaces of the lifting arm include cushioning pads for preventing damage to the edges of the strip material in the coil.

Another type coil lifter having a pair of lifter arms is employed by spreading the lifter arms apart a distance greater than the width of the coil. The coil lifter then is lowered to a position onto the top of the coil until the lifting surface at the lower end of one of the lifting arms is positioned for entry adjacent to the central opening on one side of the coil and the lifting surface at the lower end of the other of the lifting arms is adjacent the central opening on the other side of the coil. The lifter arms then are moved together for closure about the ends of the coil. The coil is lifted by the crane when the lifting surfaces of the lifting arms contact the upper curvature of the central opening. For example, U.S. Pat. No. 4,641,876; incorporated herein by reference, discloses a coil lifter including a pair of spaced lifter arms. The inside front wall surface of each lifter arm includes a coil edge protective insert for preventing damage to the edges of the strip in the coil. The insert includes a pair of spaced guide rollers with each roller mounted by a pin to a pair of spaced side plates. An endless belt is mounted onto the guide rollers for contacting the edges of the strip material of the coil.

A disadvantage of the prior art protective type devices used with coil lifters is that the protective device may easily be damaged by the strip edge with the device thereby quickly becoming ineffective for preventing damage to subsequent coils transported. The protective device becomes damaged as the lifting arm moves along the coil sidewall in an abrasive manner with the edges of the strip material cutting and shredding the protective device. Another disadvantage is that the mounting frame and protective device was installed without consideration for rebalancing. An out-of-balance C-hook impacts a coil sidewall with a dead blow, instead of swinging from the balance point of the lifting eye.

Accordingly, there remains a need for a coil lifting device that prevents damage to an edge of a coil caused by the impact of the coil lifting arm into and along the edge of the coil. There remains a need for a coil lifting device that does not have to be replaced frequently. There also remains a need for a coil lifting device that is balanced so that the coil lifting device swings from the lifting eye.

BRIEF SUMMARY OF THE INVENTION

A principal object of the invention is to provide a coil lifting device that prevents damage to a edge of a coil.

Another object of the invention is to provide a coil lifting device that includes means for preventing damage to the edge of the coil wherein the prevention means does not have to be replaced frequently.

An additional object of the invention is to provide a coil lifting device that includes means for preventing damage to the edge of a coil wherein the prevention means can be replaced easily.

Additional objects include a coil lifting device that can absorb the uneven wraps in a coil side wall and still allow vertical lifting of the coil, without damaging the coil lifting device or the uneven wraps.

The invention relates to a coil lifter used for transporting a coil of strip material such as steel, aluminum, copper, paper and the like which includes means for protecting the edges of the coil. The coil lifter includes a lifting arm having a lifting surface for being inserted into a central opening of the coil. The lifting arm includes a facing surface for being positioned adjacent to the coil edge, a side surface and a roller rotatably supported by the lifting arm. An annular outer surface of the roller extends beyond the facing surface to a point between the facing surface and the coil edge. The roller prevents damage to the edge of the coil when the lifting surface is inserted into the central opening of the coil by preventing the facing surface from otherwise contacting the edge of the coil.

Another feature of the invention is for the aforesaid roller being a wheel.

Another feature of the invention is for the aforesaid roller being a pair of spaced apart wheels.

Another feature of the invention is for the aforesaid wheels being laminated elastic material.

Another feature of the invention is for the aforesaid wheels being vertically off-set relative to one another.

Another feature of the invention is for the aforesaid coil lifter being a C-hook.

Another feature of the invention is for the aforesaid coil lifter to include a pair of lifting arms.

Advantages of the invention include a coil lifting device for preventing damage to an edge of a coil that does not have to be replaced frequently and can be replaced easily and inexpensively.

The above and other objects, features and advantages of the invention will become apparent upon consideration of the detailed description and appended drawings.

DETAILED DESCRIPTION OF THE PREFERRED EMBODIMENT

The invention relates to a lifting device used for transporting a coil of wound strip material such as steel, aluminum, copper, paper and the like. More particularly, this invention relates to a coil lifter which protects an edge of the coil, especially an uneven or impaling strip edge, by providing cushioning means on a lifter arm to prevent the lifter arm from damaging the coil edge when picking up and transporting the coil. Uneven strip edges may be caused by off gage strip, telescoping of the coil because of improper tension on the strip, improper winding of the strip on a mandrel and the like.

Figure 1:
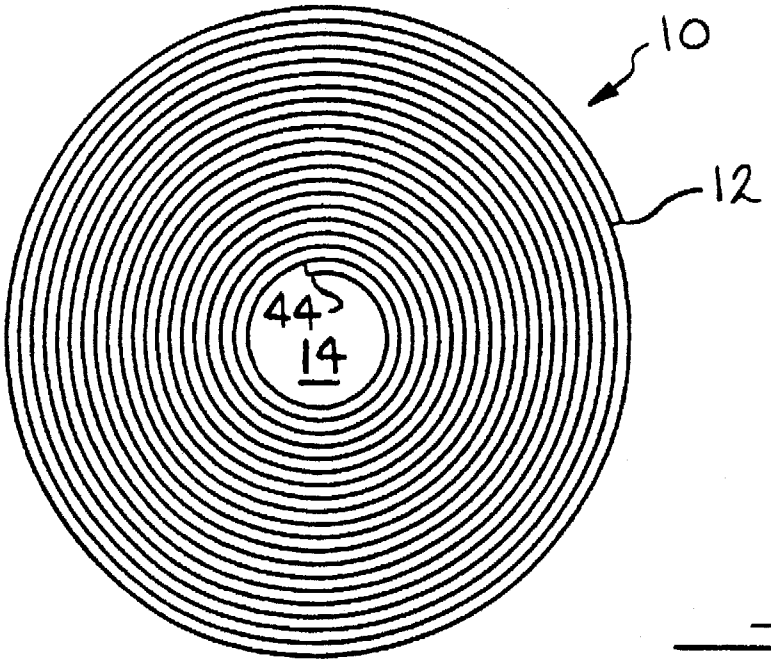
FIG. 1 is a side elevation view of a coil of strip material of the type to be lifted and transported by a lifting device of the invention.

Referring to FIG. 1, reference numeral 10 denotes a coil of strip material 12 with a central opening or core 14 extending horizontally through the center of the coil. Coil 10 includes opposite edges 16 and 18 corresponding to the edges of strip 12.

Figure 2:
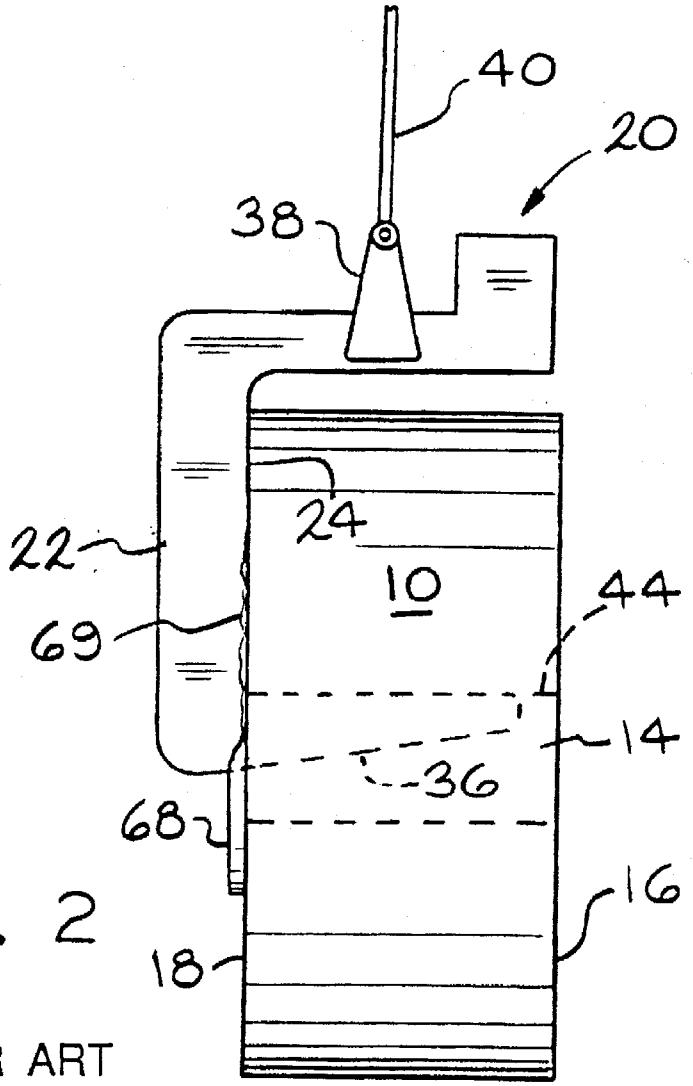
FIG. 2 PRIOR ART
FIG. 2 is an end elevation view of a conventional lifting device illustrating a lifting arm inserted into a central opening of the coil of FIG. 1.

FIG. 2 generally illustrates a conventional "C" hook type coil lifter 20 including a vertical lifting arm 22 having a facing surface 24. Without any type of coil edge protection means, facing surface 24 may be thrust into intimate contact with coil edge 18 of coil 10 as illustrated in FIG. 2 when a lifting surface of the lifting arm is fully inserted into central opening 14 of the coil. Edges 16 and 18 of strip 12 normally will be soft and can be severely damaged if facing surface 24 is slammed into edge 18 of coil 10. Numeral 68 represents an uneven strip edge with portion 69 being damaged by inside facing surface 24 of the lifting arm.

Figure 3:
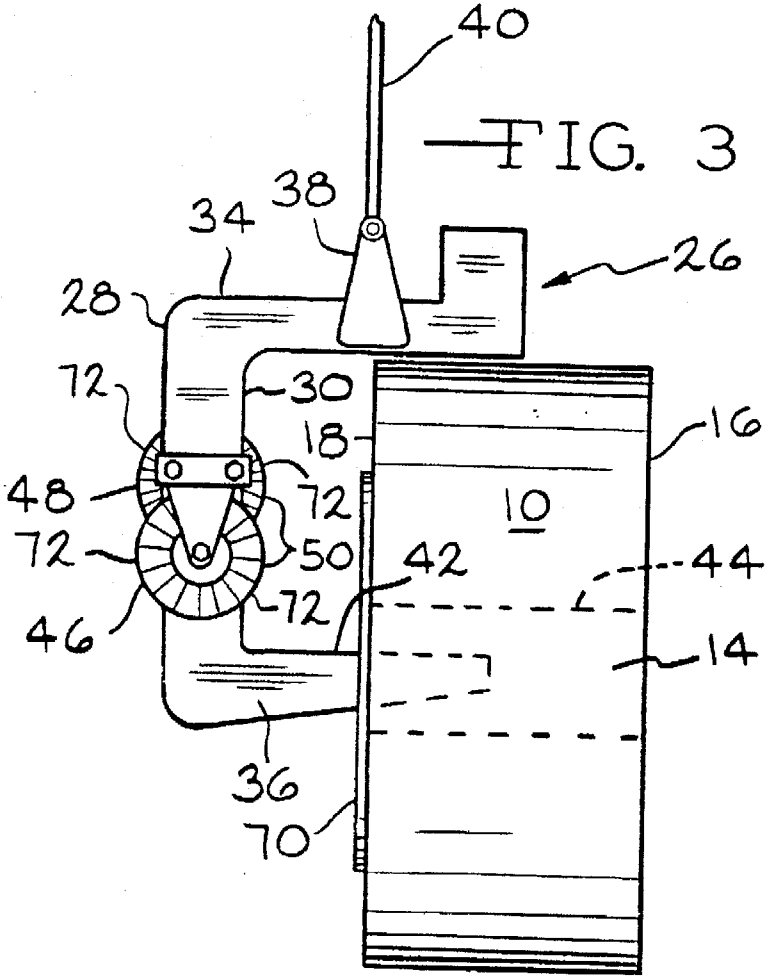
FIG. 3 is a side elevation view of the lifting device of this invention illustrating a lifting arm about to be inserted into the central opening of the coil of FIG. 1.
Figure 8:
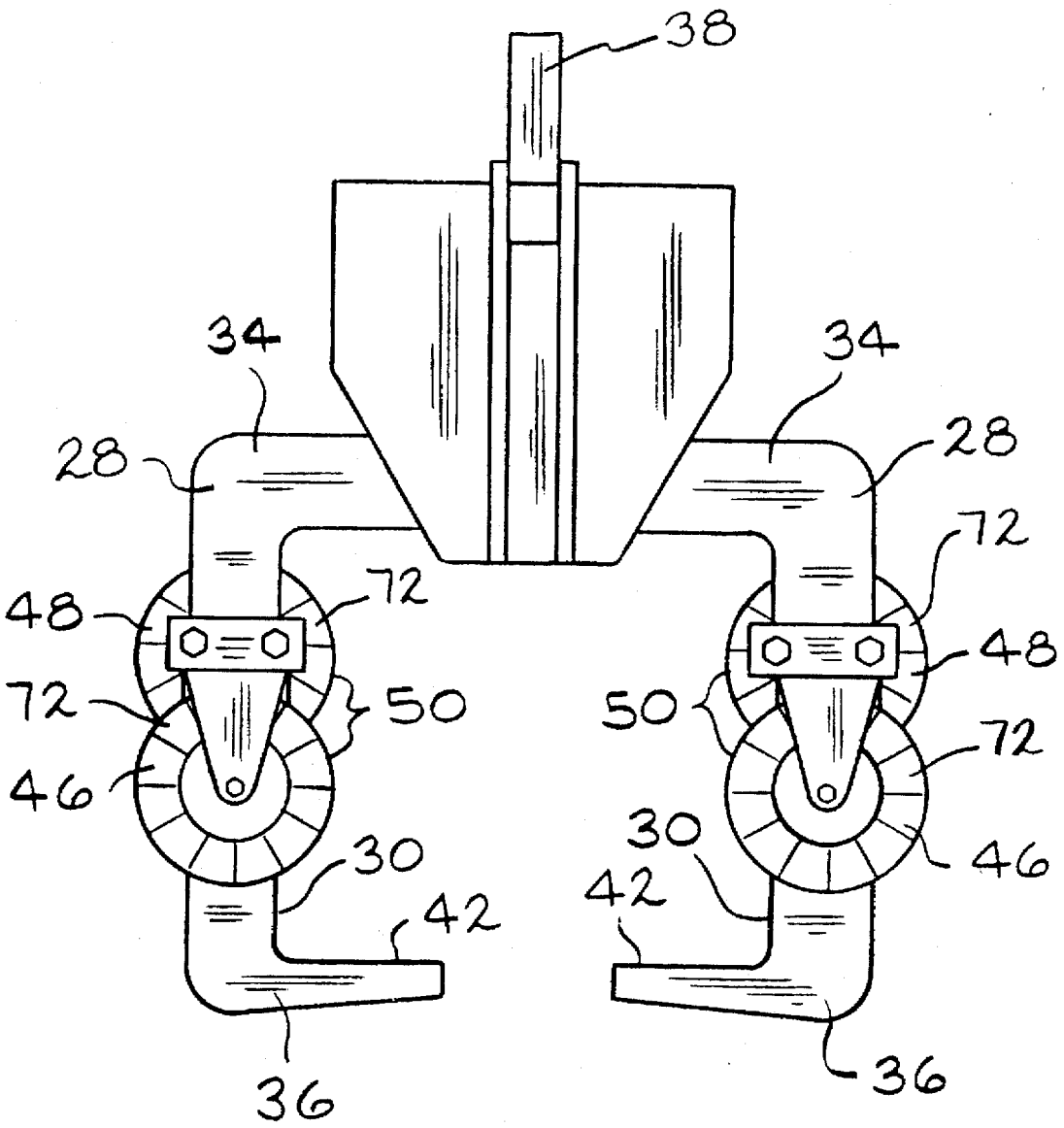
FIG. 8 is a side elevation view of the lifting device of this invention illustrating a pair of spaced vertically extending lifting arms.

FIG. 3 illustrates a "C" hook type coil lifter 26 of this invention adapted for being suspended by a cable 40 connected to a clevis 38 from an overhead crane (not shown) for lifting coil 10 having an uneven edge 70. The coil lifter may include one or two vertical lifting arms such an arm 28. The lifting arm has a facing surface 30 for being positioned adjacent to edge 18 of coil 10, a pair of side surfaces 32 and 33, an upper portion 34, a lower portion 36 and means for preventing damage to the edge of the coil such as a pair of rollers 46, 48. Lower arm portion 36 includes a lifting surface 42 for being inserted into central opening 14 of the coil. Each roller is rotatably mounted to one of opposite side surfaces 32/33 of the lifting arm so that an annular outer surface 50 of each roller extends beyond facing surface 30 to a point between facing surface 30 and coil edge 18 thereby preventing metal-to-metal contact between facing surface 30 of the lifting arm and coil edge 18. Although the coil lifter embodiment of this invention is described as having only one lifter arm, it will be understood the protection means of this invention can be adapted for use with coil lifters of the type including a pair of lifter arms, as illustrated in FIG. 8, wherein the lifter arms are for insertion into opposite ends of the central opening of the coil.

A preferred embodiment of the protection means illustrated in FIG. 3 includes a pair of spaced rollers 46 and 48. Using a pair of rollers helps to stabilize the lifting arm in the horizontal plane if the outer surface of the rollers were to contact the coil edge. Rollers 46 and 48 advantageously are mounted in a slight off-set as indicated by the distance "O" in FIG. 6. Having the rollers off-set a short distance relative to one another helps to minimize cocking by the lifting arm in the vertical plane. An off-set distance of about 21 cm was determined to function very well. Roller 48 is mounted to side surface 32 and roller 46 is mounted to a side surface 33. Rollers having a diameter of about 37 cm were found suitable. Preferably, the outer annular contacting surface of the each roller is made from laminations 72 of an elastic material radiating outwardly from a center of each roller such as compressed synthetic rubber. A laminated roller resists damage very well by uneven coil edge 70 and is sufficiently pliable so as not to damage the edge of the coil.

Figure 6:
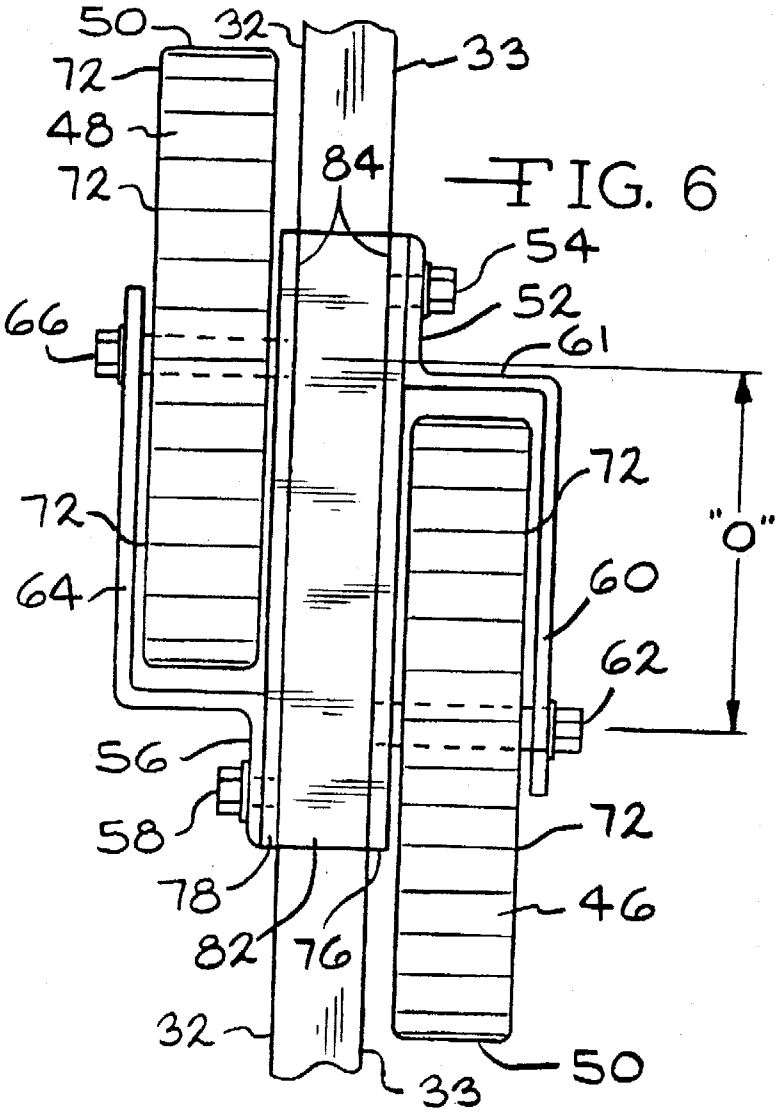
FIG. 6 is an enlarged end view of the lifting device of FIG. 5
Figure 5:
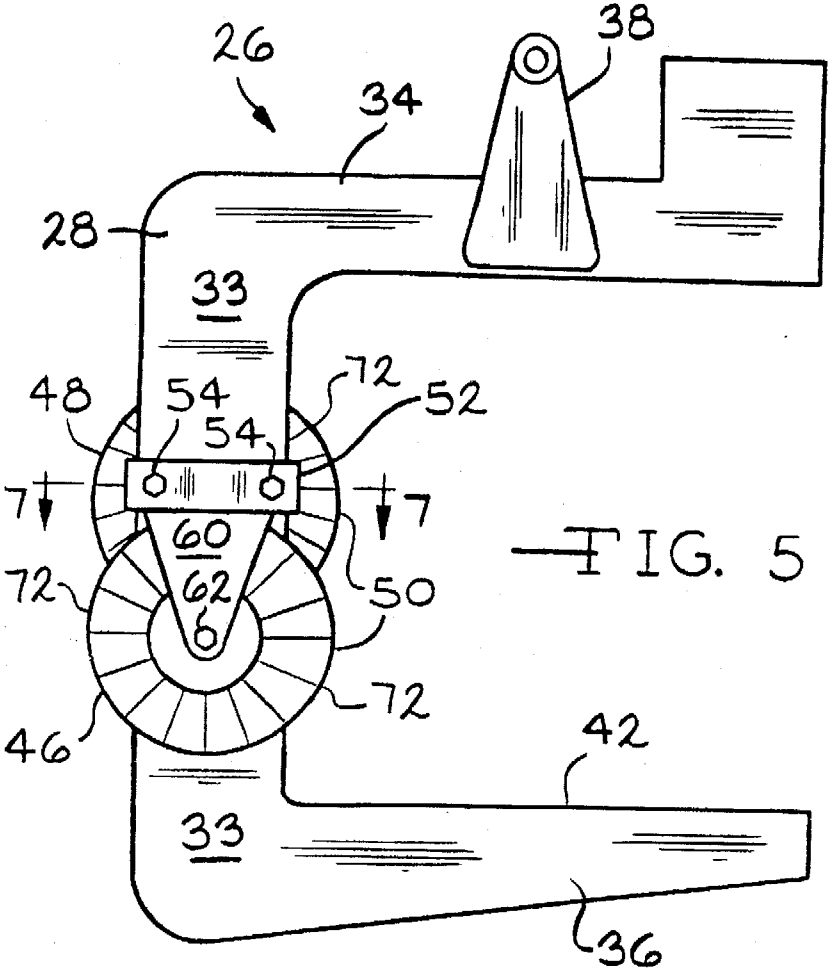
FIG. 5 is an enlarged side elevation view of the lifting device of FIGS. 3 and 4 with the coil removed.

As best seen in FIGS. 5 and 6, roller 46 is mounted to the lifting arm by a plate 52 connected to a support frame 74 by a pair of machine screws 54 and roller 48 is mounted to the lifting arm by a plate 56 connected to support frame 74 by a pair of machine screws 58. Plate 52 includes a flange 60 having an upper surface 61 with roller 46 being pivotally supported by an axle 62 extending through flange 60. Plate 56 includes a flange 64 with roller 48 being pivotally supported by an axle 66 extending through flange 64.

Figure 7:
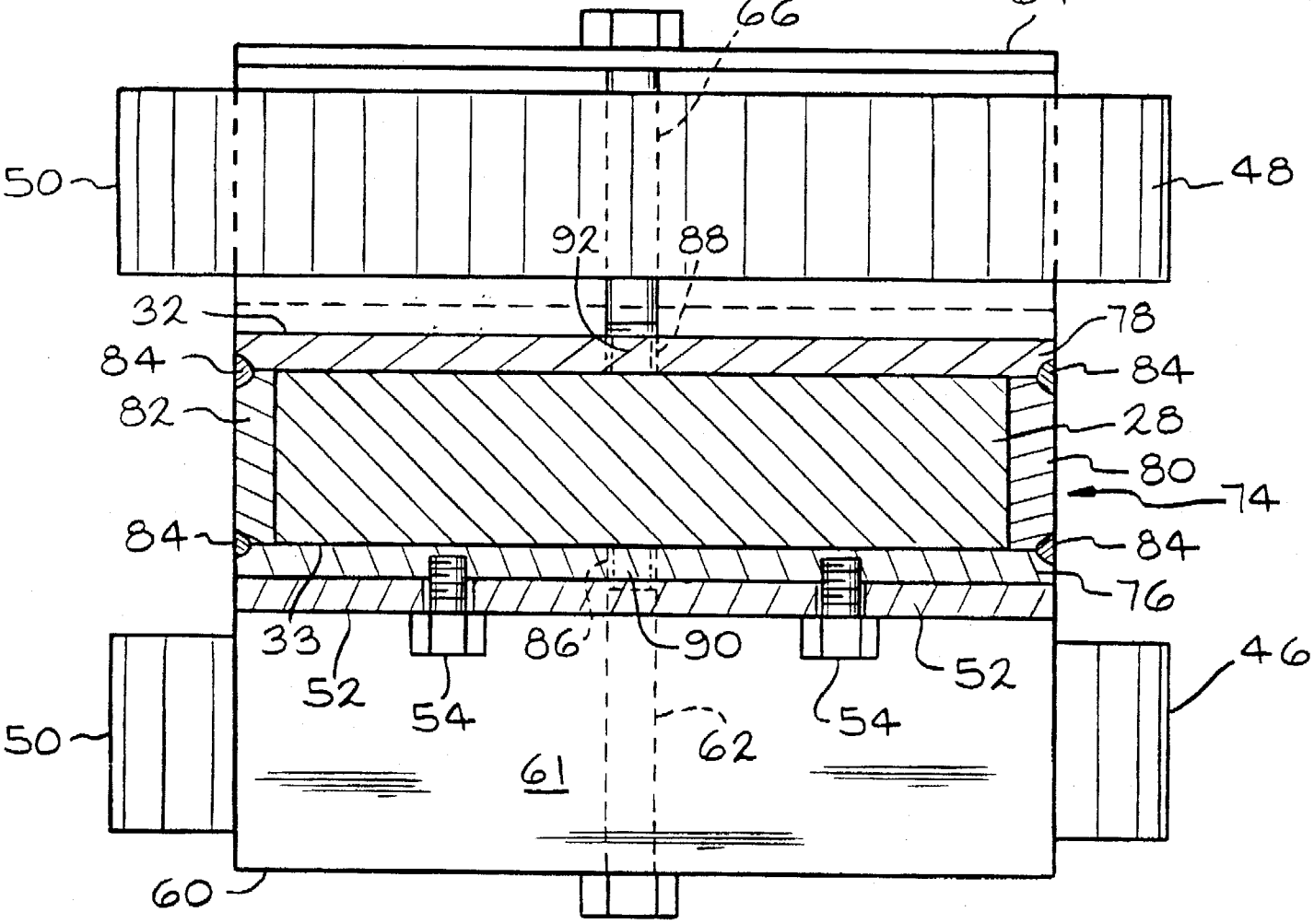
FIG. 7 is a section view taken along line 7—7 of the lifting device of FIG. 5.

FIG. 7 is a section view taken along line 7—7 of FIG. 5 illustrating detail of support frame 74. Support frame 74 may be assembled from a pair of plates 76 and 78 spaced apart by a pair of relatively shorter plates 80 and 82. The four plates may be connected such as by welding along weld seams 84. Support frame 74 is tightly held to lifting arm 28 by frictional contact. Plate 76 is provided with a threaded bore 86 for receiving a threaded terminal end 90 of axle 62 and plate 78 is provided with a threaded bore 88 for receiving a threaded terminal end 92 of axle 66.

Figure 4:
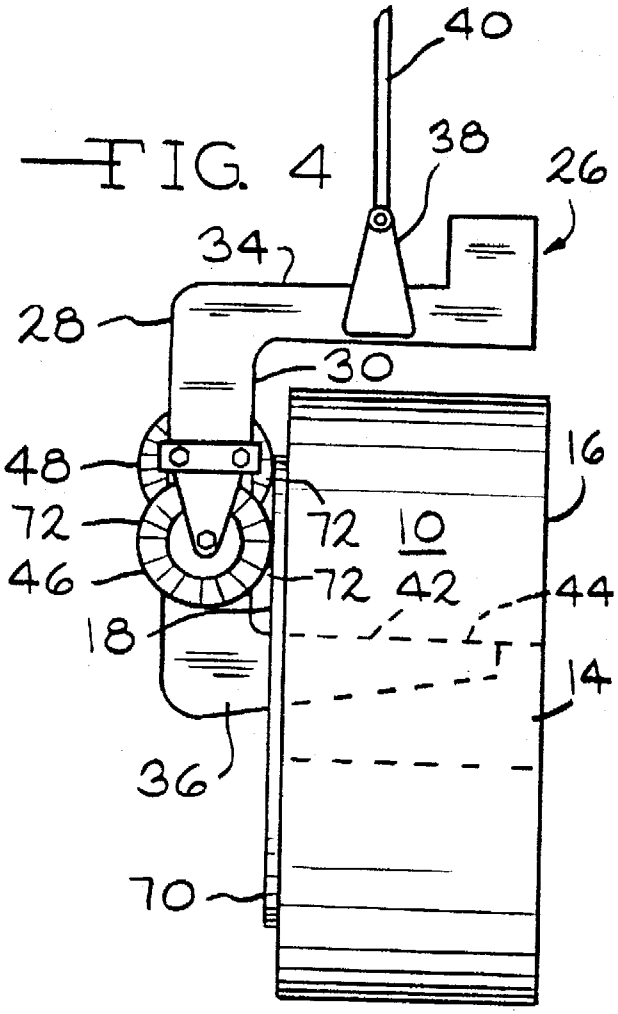
FIG. 4 is the same as FIG. 3 with the lifting arm fully inserted into the central opening of the coil.

Functioning of the invention now will be described. FIG. 3 illustrates lower arm portion 36 of the coil lifter about to be inserted into central opening 14 of the coil. At this point, outer surfaces 50 of rollers 46 and 48 are not in contact with coil edge 18 or uneven edge 70. FIG. 4 illustrates lower arm portion 36 of the coil lifter fully inserted into central opening 14 of the coil to the extent that outer surfaces 50 of rollers 46 and 48 now are in contact with uneven coil edge 70. As the coil lifter is raised by an overhead crane, lifting surface 42 of lower arm portion 36 travels upwardly a short distance before finally contacting an upper curvature 44 of central opening 14. While lower arm portion 36 travels upwardly, surfaces 50 of the rollers are free to "travel" or roll upwardly while being in intimate contact along edge 18 or uneven edge 70 as the coil lifter slowly is raised with lifting surface 42 engaging curvature 44 of central opening 14.

It will be understood various modifications may be made to the invention without departing from the spirit and scope of it. Therefore, the limits of the invention should be determined from the appended claims.

What is claimed is:

1. A lifter for transporting a coil of strip material having a central opening, comprising:

a coil lifter for being suspended from an overhead crane, the coil lifter including a lifting arm for being inserted into the central opening of the coil and a wheel for preventing damage to a coil edge when the lifting arm is inserted into the central opening, an annular outer surface of the wheel being a laminated material radiating outwardly from a center of the wheel, the lifting arm including at least two vertically extending surfaces and a lifting surface, one of the vertically extending surfaces adjacent to the coil edge, the wheel being rotatably mounted to the other vertically extending surface of the lifting arm wherein the annular outer surface of the wheel is positioned between the coil edge and the one surface thereby preventing the one surface from making inadvertent contact with the coil edge.

2. The coil lifter of claim 1 wherein the outer surface of the wheel is a compressed laminated synthetic rubber.

3. The coil lifter of claim 1 including a pair of spaced wheels, the wheels mounted on opposite sides of the lifting arm.

4. The coil lifter of claim 3 wherein the wheels are vertically off-set from one another.

5. The coil lifter of claim 1 wherein the lifting arm includes a horizontally extending lower portion.

6. The coil lifter of claim 5 wherein the lifting arm includes an upper portion extending parallel to the lower portion.

7. The coil lifter of claim 6 being a C-hook.

8. The coil lifter of claim 1 wherein the coil of the strip material having the central opening is steel.

9. The coil lifter of claim 1 including a pair of spaced vertically extending lifting arms, the lower end of each arm including the lifting surface wherein one lifting surface is for insertion into one end of the central opening and the other lifting surface is for insertion into the other end of the central opening.

10. The coil lifter of claim 1 including a support frame.

11. The coil lifter of claim 10 wherein each of the rollers is supported by an axle, the terminal ends of each axle being supported by the support frame.

12. The coil lifter of claim 11 wherein the support frame is connected to the lifting arm by frictional contact.

13. A lifter for transporting a coil of strip material having a central opening, comprising:

a coil lifter for being suspended from an overhead crane, the coil lifter including a vertical lifting arm having a lower potion for being inserted into the central opening of the coil and a pair of spaced apart wheels for preventing damage to a coil edge when the lower portion is inserted into the central opening, the lifting arm including at least two juxtaposed vertically extending surfaces, another vertically extending surface intermediate the juxtaposed surfaces and a lifting surface on the lower portion, the intermediate surface adjacent to the coil edge, each wheel having a laminated outer surface radiating outwardly from a center of the wheel and one of the wheels being rotatably mounted to one of the juxtaposed surfaces and the other of the wheels being rotatably mounted to the other of the juxtaposed surfaces of the lifting arm wherein the outer surface of the wheels is positioned between the toil edge and the intermediate surface thereby preventing the intermediate surface from making inadvertent contact with the coil edge.

14. A lifter for transporting a coil of strip material having a central opening, comprising:

a coil lifter for being suspended from an overhead crane, the coil lifter including a vertical lifting arm having a lower portion for being inserted into the central opening of the coil, a pair of spaced apart off-set wheels for preventing damage to a coil edge when the lower portion is inserted into the central opening and a frame for supporting the wheels, the lifting arm including a facing surface adjacent to the coil edge and a lifting surface on the lower portion, each wheel having a laminated elastic outer surface radiating outwardly from a center of the wheel and being rotatably mounted to the frame wherein the outer surface of the wheels is positioned between the coil edge and the facing surface thereby preventing the facing surface from making inadvertent contact with the coil edge.

* * * * *